US006860698B1

(12) United States Patent
Virágh et al.

(10) Patent No.: US 6,860,698 B1
(45) Date of Patent: Mar. 1, 2005

(54) APPARATUS FOR MOVING CONTAINERS

(75) Inventors: Lajos Virágh, Budapest (HU); László Brezovits, Budapest (HU)

(73) Assignee: Mikon Kft. Mérnöki, Müvészeti és Idegenforgalmi Kft., Budapest (HU)

( * ) Notice: Subject to any disclaimer, the term of this patent is extended or adjusted under 35 U.S.C. 154(b) by 84 days.

(21) Appl. No.: 10/110,898

(22) PCT Filed: Oct. 18, 2000

(86) PCT No.: PCT/HU00/00107

§ 371 (c)(1),
(2), (4) Date: Apr. 18, 2002

(87) PCT Pub. No.: WO01/28836

PCT Pub. Date: Apr. 26, 2001

(30) Foreign Application Priority Data

Oct. 18, 1999 (HU) ..... 9903643

(51) Int. Cl.[7] ..... B66F 9/06

(52) U.S. Cl. ..... 414/458; 414/340; 414/392; 414/542

(58) Field of Search ..... 414/340, 341, 414/344, 391, 392, 458, 542, 619, 659, 660

(56) References Cited

U.S. PATENT DOCUMENTS

| | | | | | |
|---|---|---|---|---|---|
| 1,821,340 | A | * | 9/1931 | Guilbert et al. | 104/3 |
| 2,773,612 | A | * | 12/1956 | West et al. | 414/392 |
| 2,773,614 | A | * | 12/1956 | Edwards et al. | 414/458 |
| 3,490,622 | A | * | 1/1970 | Brackin | 414/542 |
| 3,637,100 | A | | 1/1972 | McMillan | |
| 4,219,122 | A | * | 8/1980 | Blatchford | 212/73 |
| 4,234,287 | A | * | 11/1980 | Lassig et al. | 414/542 |
| 4,385,861 | A | * | 5/1983 | Blatchford | 414/542 |
| 4,518,304 | A | * | 5/1985 | Blatchford | 414/542 |
| 4,936,733 | A | * | 6/1990 | Girerd | 414/458 |
| 4,961,680 | A | * | 10/1990 | Riedl et al. | 414/458 |
| 5,595,313 | A | * | 1/1997 | Kroll et al. | 212/225 |
| 5,800,114 | A | * | 9/1998 | Secondi | 414/458 |
| 5,842,589 | A | * | 12/1998 | Kroll et al. | 212/299 |

FOREIGN PATENT DOCUMENTS

| | | | |
|---|---|---|---|
| DE | 1 531 990 | | 3/1970 |
| DE | 25 21 087 | A1 | 12/1975 |
| DE | 4127202 | A1 * | 2/1993 |
| DE | 4126728 | * | 1/1996 |
| EP | 486942 | A1 * | 5/1992 |
| FR | 2018423 | * | 5/1970 |
| GB | 2056413 | A | 3/1981 |
| GB | 2064487 | A | 6/1981 |
| GB | 2111023 | A | 6/1983 |
| WO | WO92/21565 | A | 12/1992 |
| WO | WO96/17797 | A | 6/1996 |
| WO | 97/03014 | A1 | 1/1997 |
| WO | WO 97/48636 | * | 12/1997 |

* cited by examiner

*Primary Examiner*—James W. Keenan
(74) *Attorney, Agent, or Firm*—Venable LLP; Robert Kinberg

(57) ABSTRACT

An apparatus operative to perform at least one of lifting and moving containers. A base structure is provided with wheels, counter-weight and supports on both sides. Transverse beams are arranged on the on the base structure parallel with axles of the wheels. The beams include container moving units. The base structure includes two base cars arranged antimerically to and movable synchronously with each other, both base cars include container moving units having upper and lower container grips. The container moving units include at least one of traveling lower and upper lifting beams bearing at least a part of the container grips.

16 Claims, 22 Drawing Sheets

APPARATUS FOR MOVING CONTAINERS

FIELD OF THE INVENTION

The present invention relates to an apparatus for moving containers, comprising a base structure with wheels, counter-weight and supports on both sides; wherein transverse beams are arranged on the base structure, parallel with the axles of said wheels, and said beams are bearing container lifting units. The apparatus can be used for a wide variety of purposes: lifting and/or moving any kind of (standard or out of standard) containers especially for unloading containers from railway cars or other transporting means, rearranging containers, loading railway cars or other transporting means or transferring containers from one transporting means to another.

BACKGROUND OF THE INVENTION

Loading, unloading or transferring containers is generally carried out by cranes or other lifting devices, wherein the containers are lifted from the side or from the top, depending on the corresponding standard. Moving containers by cranes, however, is a problem at all railways with overhead wires. For safety reasons, special Diesel mechanical locomotives must be used to move the trains to a loading station wherein moving of the containers can be carried out without the danger of contacting the overhead wires.

This type of loading is time consuming and expensive due to the operating and the maintenance costs of the cranes, the loading stations, the tracks and the locomotives. For this reason, the share of container transport by train is far below the reasonable volume. Technical development has been limited, however, almost exclusively to lifting devices with little attention given to loading and unloading.

Forklift trucks are used if the containers to be moved are out of reach of the cranes. The main drawback in using these trucks is that lifting and lowering can only be carried out on the same side. Further disadvantage is that the containers are lifted rather high which results in the same safety hazard with the overhead wires.

U.S. Pat. No. 3,637,100 discloses a swing shift forklift truck having a lift assembly attached to the side of a single-swing arm. The vehicle is capable of operating either as a front loader or as a side loader but can only be used in storehouses where the loads must be moved in relatively small spaces.

DE 25 21 087 discloses another lift assembly arranged on the container transporting vehicle itself. The lift assembly is rolling on rails mounted on one or both sides of the vehicle during loading or unloading. The assembly as described is clearly not capable of loading or rearranging containers and, moreover, providing all container transporting vehicle with such lift assemblies would result in unrealistic costs.

The apparatus described in the DE AS 1 531 990 is mounted on a vehicle provided with wheels and is used for loading containers. The lift assembly is moving on rails attached to and overreaching the vehicle on both sides. The containers are lifted and lowered between the rails. This apparatus is capable of loading, rearranging and unloading containers, however, the overreaching rails, restrain its use considerably as only single containers can be moved in this way.

As the containers are generally transported in great numbers and are coupled to each other, the use of the apparatus is rather limited.

WO 97/03014 discloses a car for lifting and/or moving containers comprising a base structure with wheels; parallel beams arranged on the base structure; container supports above the beams; carriages rolling on the beams and provided with means for lifting and/or moving containers, said means being foldable below the level of the container supports, wherein said container supports are arranged outside of the path of the carriages. This car can be used for moving containers under overhead wires but is not able to handle all kinds of containers either.

SUMMARY OF THE INVENTION

The object of the present invention is, therefore, to provide means for loading, unloading or transferring containers in a way which can easily be carried out at railways with an overhead system and, at the same time, to enable loading, unloading, storing and transferring containers without the need of removing the railway cars from the overhead system, in order to make railway transport competitive with road transport.

According to the present invention an all purpose apparatus is provided for lifting and/or moving containers, comprising a base structure with wheels, counter-weight and supports on both sides; wherein transverse beams are arranged on the base structure, parallel with the axles of said wheels; and said beams are provided with container moving units. The base structure comprises two base cars arranged antimerically to and movable in synchronism with each other and both base cars are provided with container moving units having upper and lower container grips, wherein said container moving units comprise traveling lower and/or upper lifting beams bearing at least a part of said container grips.

According to a preferred embodiment, container supports are provided above the ir beams. The container supports are preferably movable on rollers on said base cars in longitudinal direction. The container moving units may also be movable by rollers on the transverse beams preferably arranged lower than the level of the plateau of said base structures.

Between the base cars there is an electronic, radio or mechanical connection and the support of the base cars may comprise support wheels or supporting legs.

According to a preferred embodiment, the container moving units comprise lifting frames and/or lifting columns moved by lifting means, wherein said lifting means are arranged on carriages and said lifting frames and/or lifting columns comprise at least one horizontal upper console and at least a part of said container grips are on said console.

According to another embodiment, the lower and/or upper lifting beams are arranged on said lifting frames and/or lifting columns and there are foldable lifting arms on the upper lifting beams.

There may be slides moving along said lifting beams, wherein the container grips and the foldable lifting arms are carried on the slides.

When using the apparatus according to the present invention there is no need of tracks, loading places without overhead systems and Diesel engines for moving the railway cars to the loading place.

The apparatus according to the invention may be used with a lower power consumption than the cranes and can easily be automatized and controlled even in a computerized system.

The apparatus can operate under the overhead system without any danger of accident and no cut-off of the electric system is needed during operation. The speed of the loading is five or six times greater than that of the conventional methods and no air pollution is caused by Diesel engines. The apparatus is safer than the conventional cranes in view of the danger of accidents as well.

A basic advantage of the present invention is that it opens a new way of loading containers, which certainly can be developed in many ways to improve this kind of loading.

BRIEF DESCRIPTION OF THE DRAWINGS

Embodiments of the invention will now be more particularly described by way of example, with reference to the accompanying drawings in which.

DETAILED DESCRIPTION OF PREFERRED EMBODIMENTS

Figure 1:
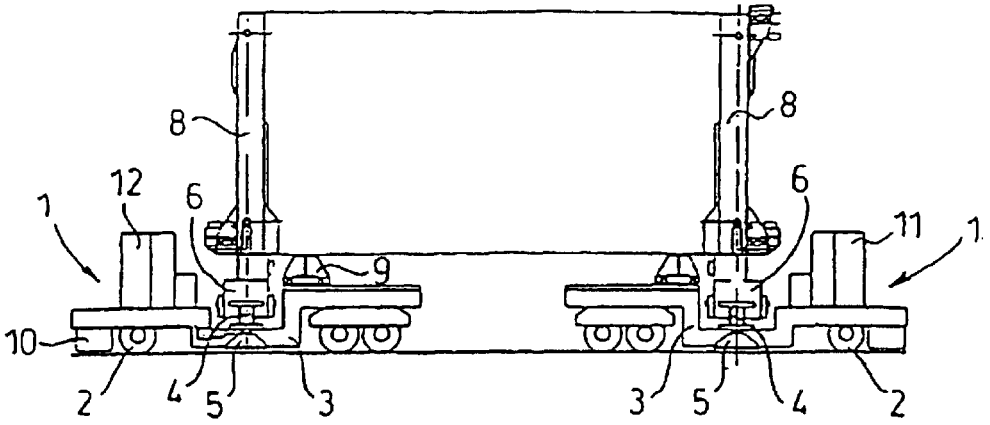
FIG. 1 is a side view of the apparatus according to the invention, during lowering a container.
Figure 2:
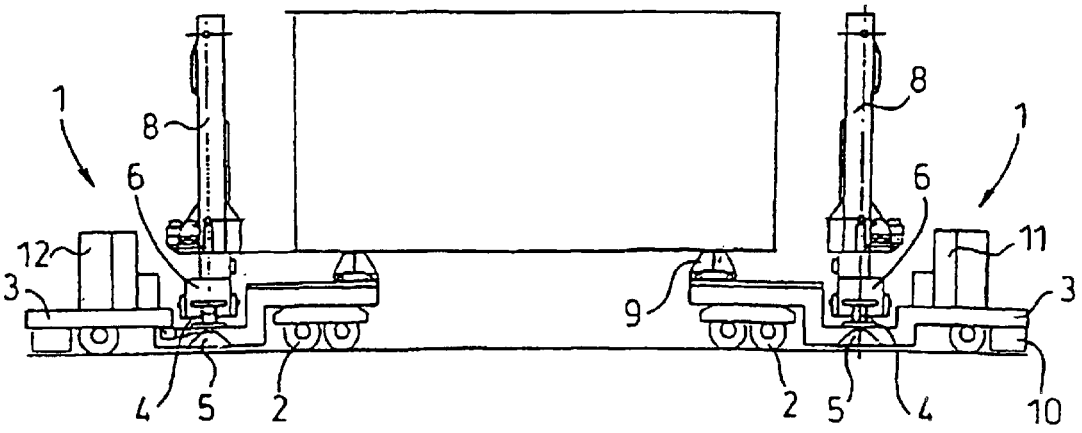
FIG. 2 is the apparatus after the step shown in FIG. 1, with the container on the supports.

FIG. 1 and FIG. 2 show a preferred embodiment of the present invention. The apparatus for moving containers comprises two base cars 1 constructed and arranged antimerically opposite to each other. They comprise base structures 3 provided with wheels 2 and transverse beams 4 in their middle sections in a lowered position. These transverse beams 4 are overreaching the base structures 3 and have supports 5 on both sides. There are carriages 6 rolling on the beams 4 and the carriages 6 are provided with container moving units comprising lifting frames 8 driven by lifting means 7. There are also container supports 9 carried by rollers on the base structures 3. The supports 9 can be simple beams or can have upper parts constructed as roller plates to enable the containers to move thereon. On the other side of the lifting means 7 there are counterweights 10, a hydraulic supply unit 11 and an electric control unit 12.

Figure 3:
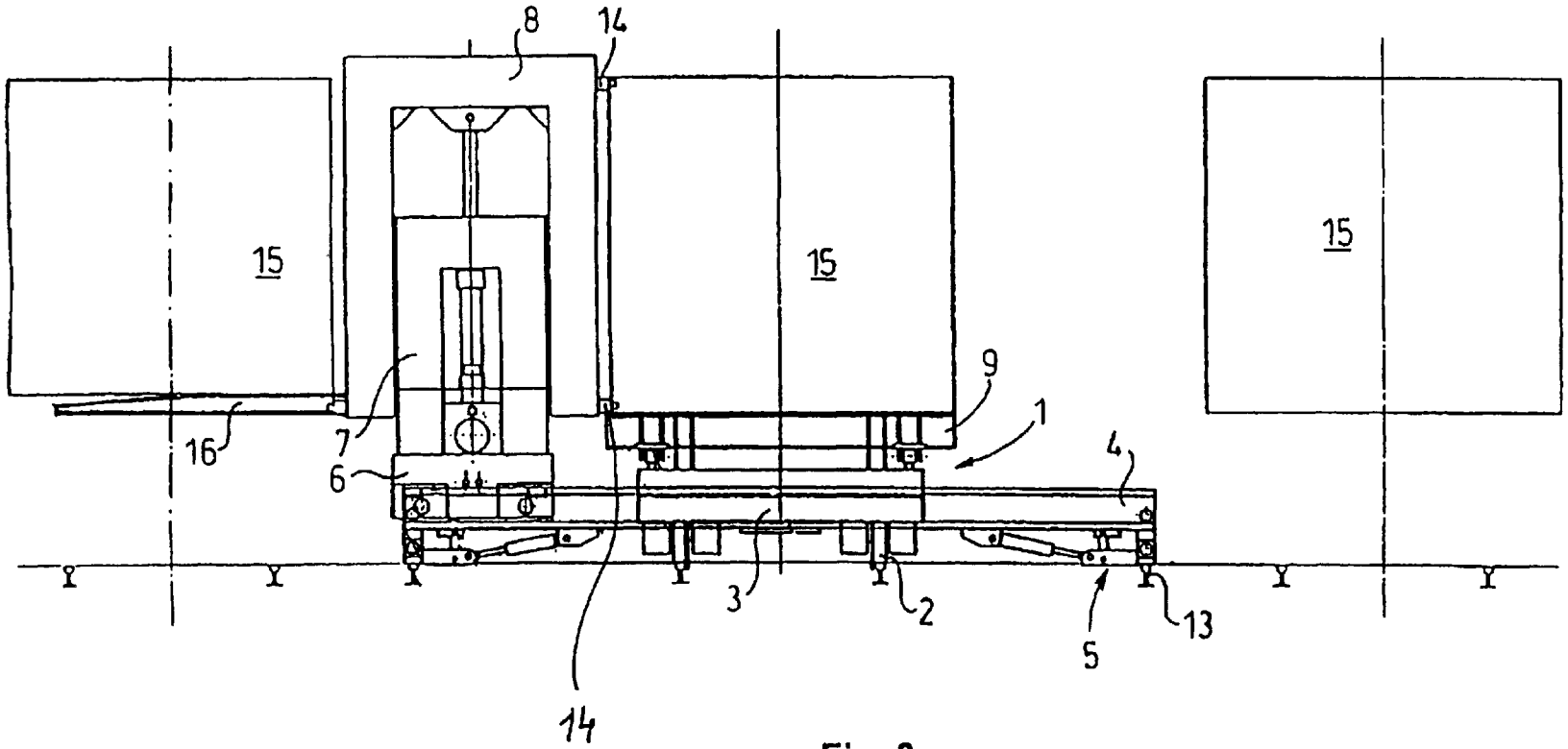
FIG. 3 shows the front view of the apparatus lifting a container with a lower lifting beam (left side) and with ISO container grips (right side) respectively.

FIG. 3 shows the front view of the apparatus according to the invention. It can be seen how the beams 4 are overreaching the base structure 3 and that supports 5 are hydraulically operated legs resting on support rails 13. Wheels rolling on the rails 13 can also be applied instead of the legs.

Lifting frame 8 is provided with container grips 14 on both sides for fitting in the standard ISO elements of the containers for lifting. Several grips (e.g. the lower ones) can be replaced by abutments, in certain cases.

On the right side of FIG. 3 a container 15 is held by container grips 14 and lowered to supports 9.

On the left side of FIG. 3 another container 15 is moved by the lower lifting beam 16 carried on the lifting frame 8. The beam can be pushed below the container, in order to lift it.

Figure 4:
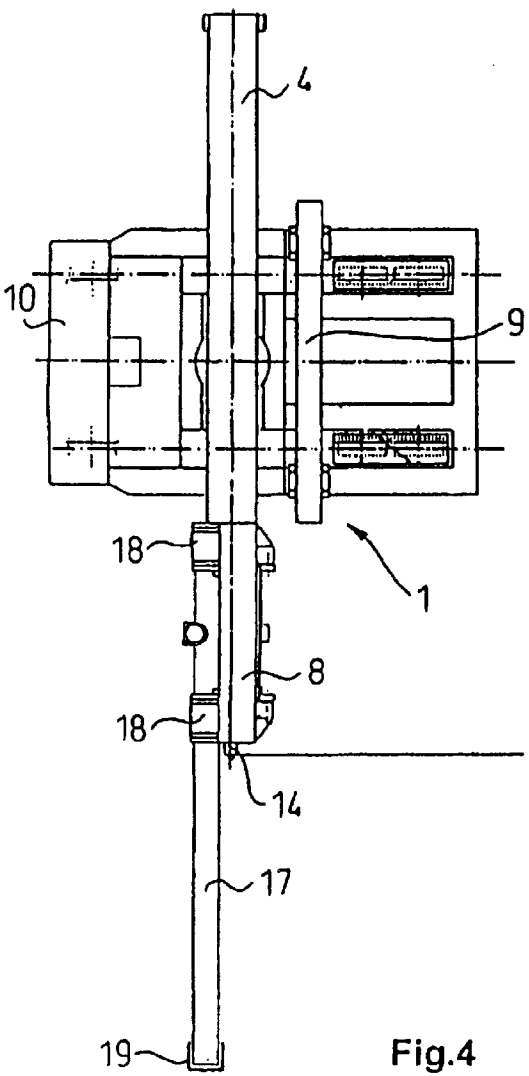
FIG. 4 is the top view of the apparatus with an extended upper lifting beam.

Lifting frame 8 can have an upper lifting beam 17 too as shown in FIG. 4. This upper lifting beam is carried by expansion brackets 18 which can slightly be moved in vertical direction. At the end of the upper beams, there are foldable arms 19 to prevent tilting of the container during loading by the lower grips 14 only.

Figure 5:
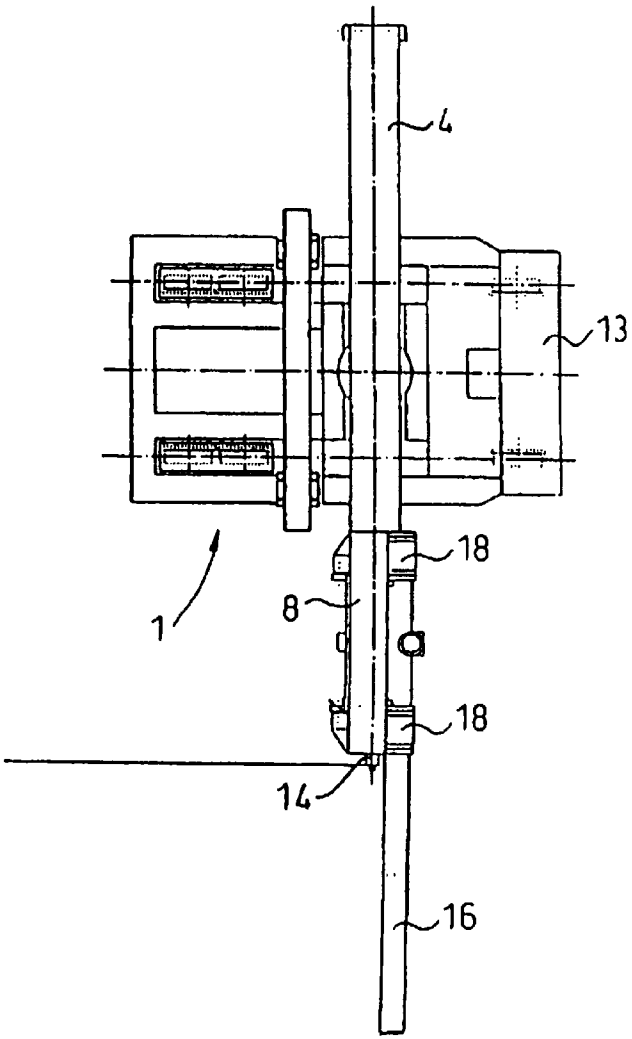
FIG. 5 is the top view of the apparatus with an extended lower lifting beam.

The lower lifting beams 16 (see FIG. 5) are of similar construction: expansion brackets 18 are on the lower part of the lifting frame 8 for bearing the beams. These beams, however, do not comprise foldable arms, but have a narrowing end section which makes it easier to push the beam below the container. The grips are fixed to the expansion brackets.

The upper lifting beams 17 are generally used for the moving of soft top (swap) containers which can not be clamped at the top and, therefore, they are not necessarily part of the apparatus. If they are applied, however, it is easy to modify the construction in a way that lifting of any kind of containers can be carried out by the upper lifting beams 17.

Moreover, it may be advantageous to construct the apparatus as a system of building blocks, which means that the basic module does not contain all of the lifting elements (upper or lower beams, folded arm, grips, extensions etc), but only the ones necessary for a given purpose. The same is valid for the other accessories as e.g. the support legs, wheels or rails. A simple lifting column may also be applied instead of the lifting frame.

The base cars are preferably controlled by an electronic system synchronized by radio connection between the cars. A mechanical system can, of course, also be applied.

The apparatus may be used as shown in FIGS. 6 to 26 wherein FIGS. 6*a* to 26*a* show front views and FIGS. 6*b* to 26*b* show top views. Referring to FIGS. 6 to 12 there is shown the process of loading without lifting beams, only with ISO grips fixed to the lifting frames.

Figure 6A:
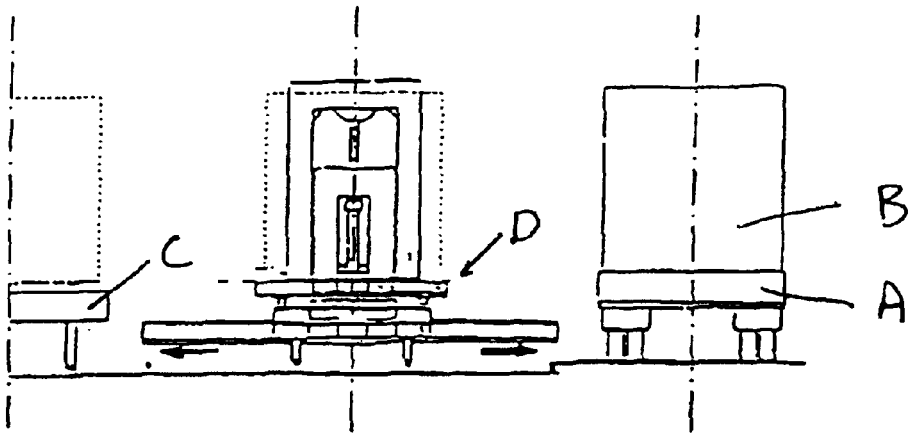
FIGS. 6 to 12 show the steps of the loading process of a container with ISO container grips.
Figure 6B:
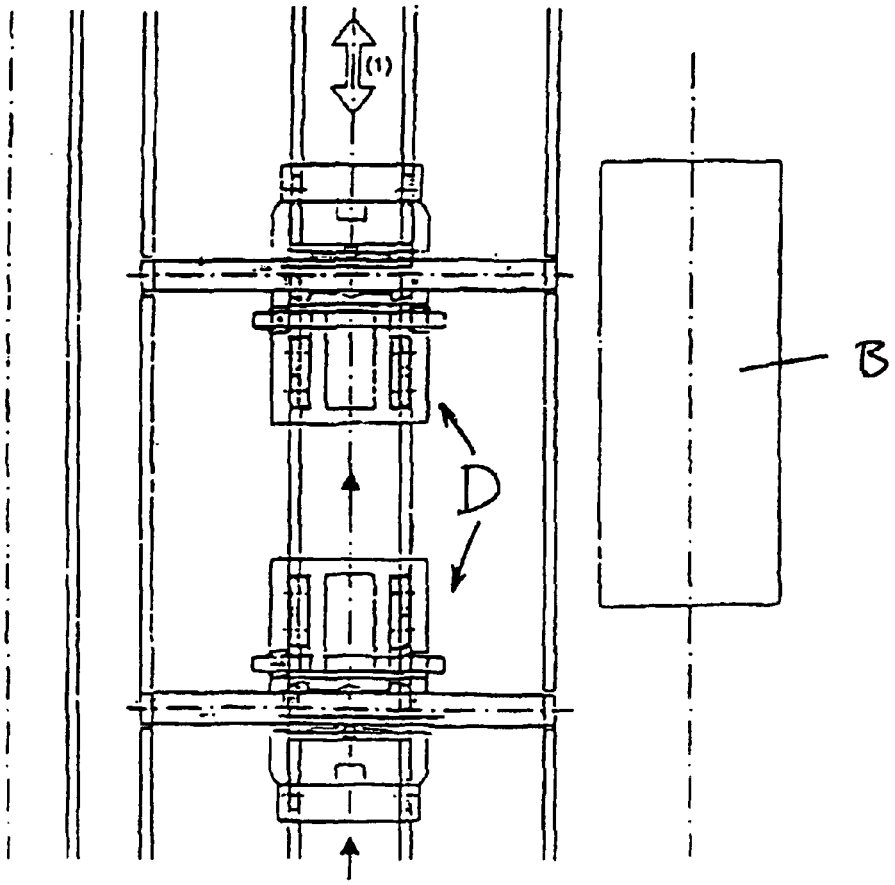
Figure 7A:
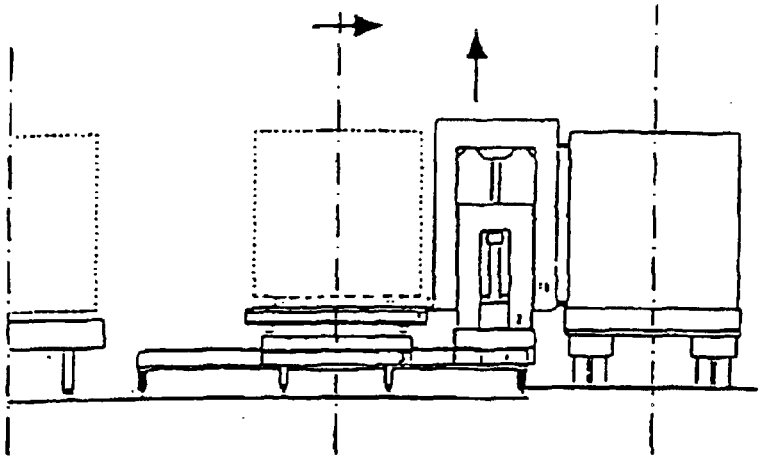
Figure 7B:
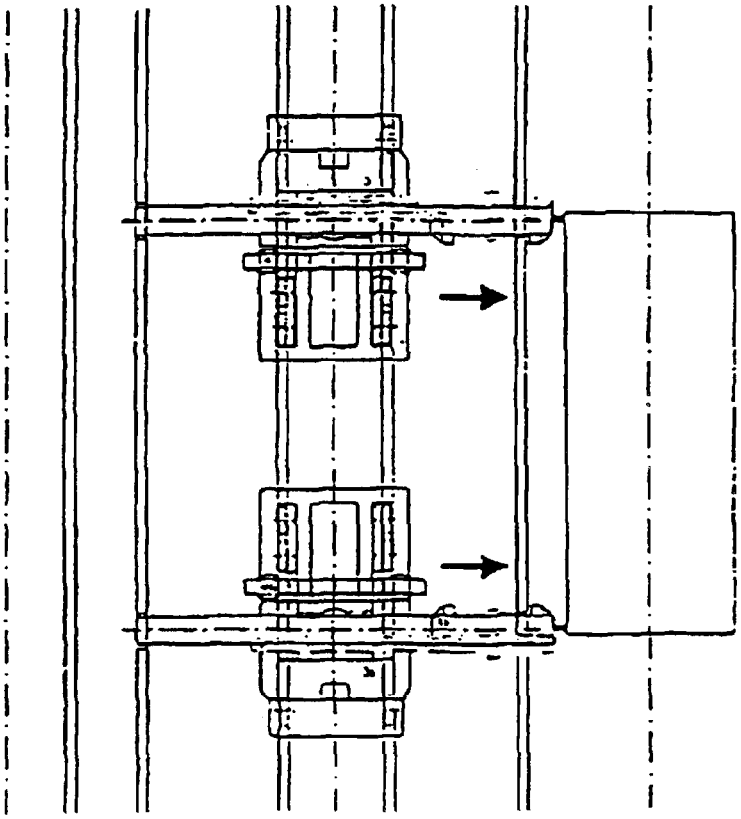

The starting position at loading is shown in FIGS. 6*a* and 6*b* wherein FIG. 6*a* shows a front view and FIG. 6*b* a top view. When truck A with containers B achieves its loading position opposite to the railway car C, base car D (according to the invention) moves to its first position wherein the container grips are in line with the ISO elements on the containers. Preferably, sensor elements are provided for adjusting to the correct position. As a second step, the overreaching beams are backed by the supports and the carriages approach the container. Following a vertical adjustment the carriages travel to the container and the grips are activated (pushed forward and turned) to clamp the container (FIG. 7).

Figure 8A:
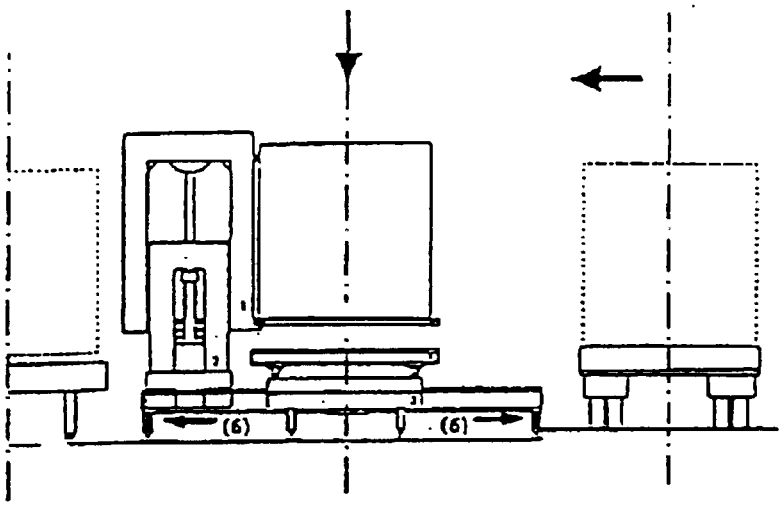
Figure 8B:
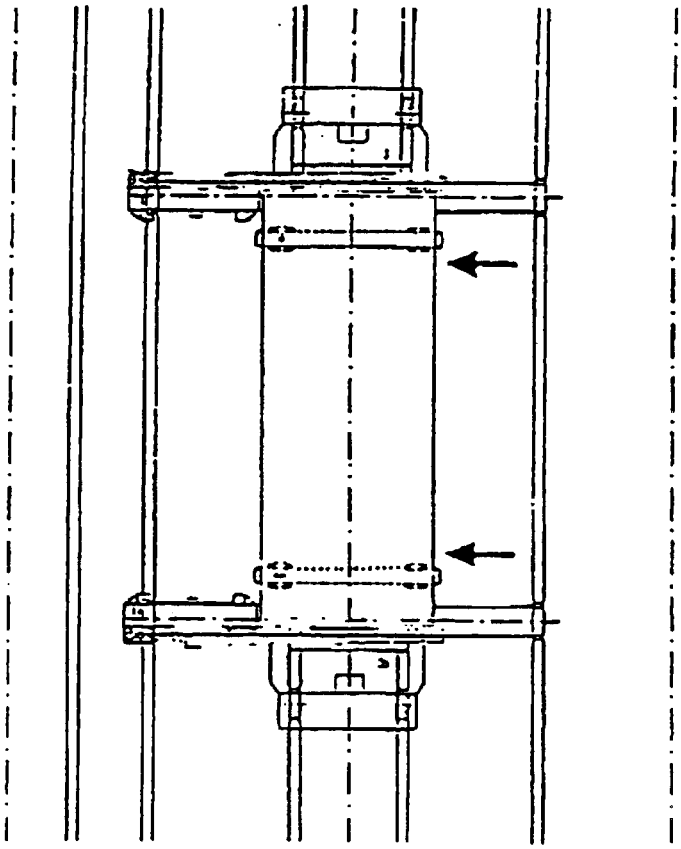
Figure 9A:
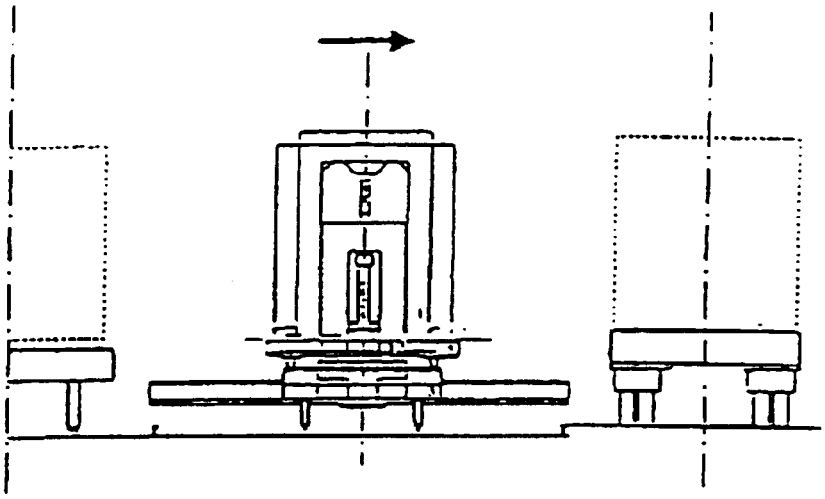
Figure 9B:
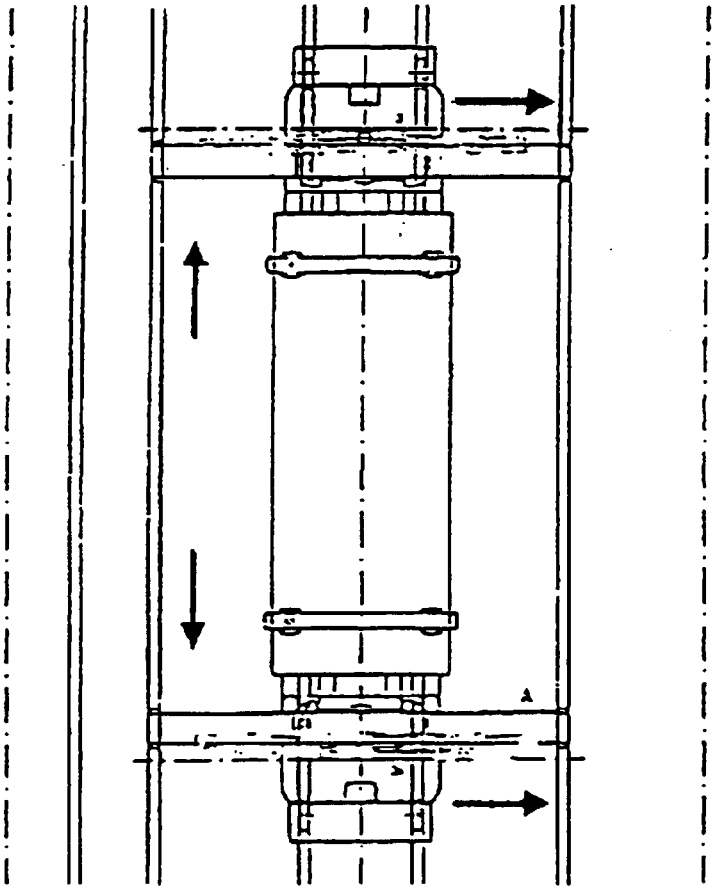
Figure 10A:
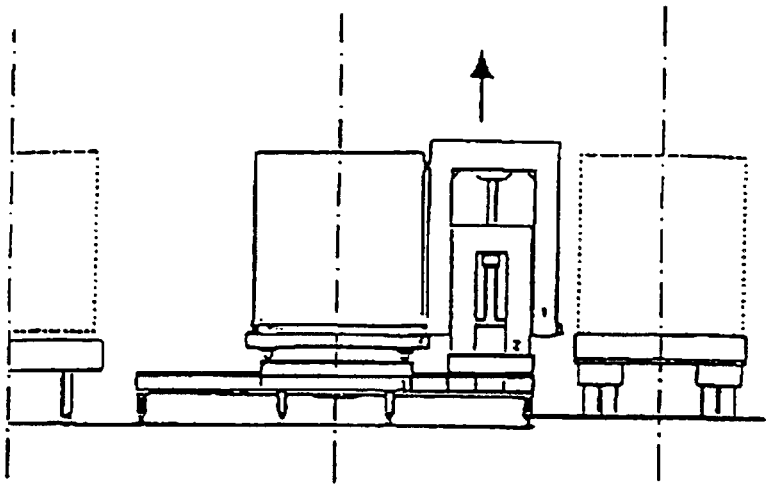
Figure 10B:
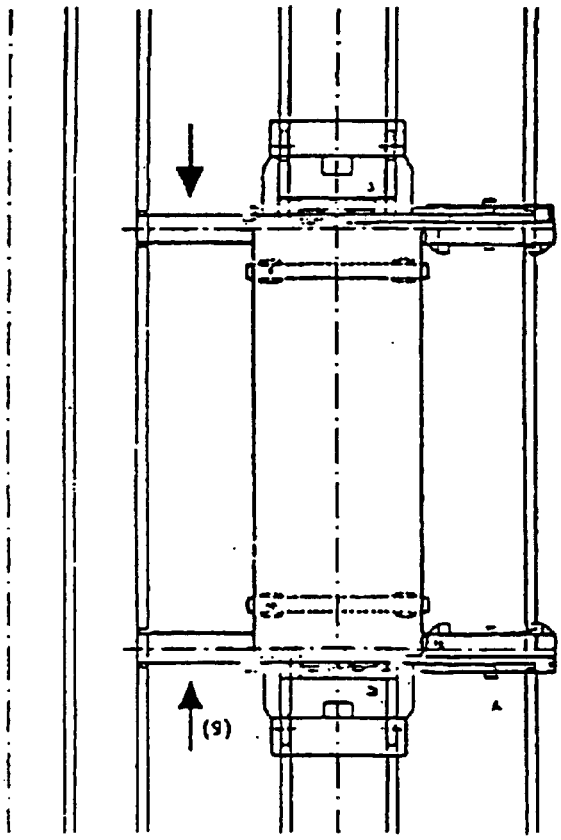
Figure 11A:
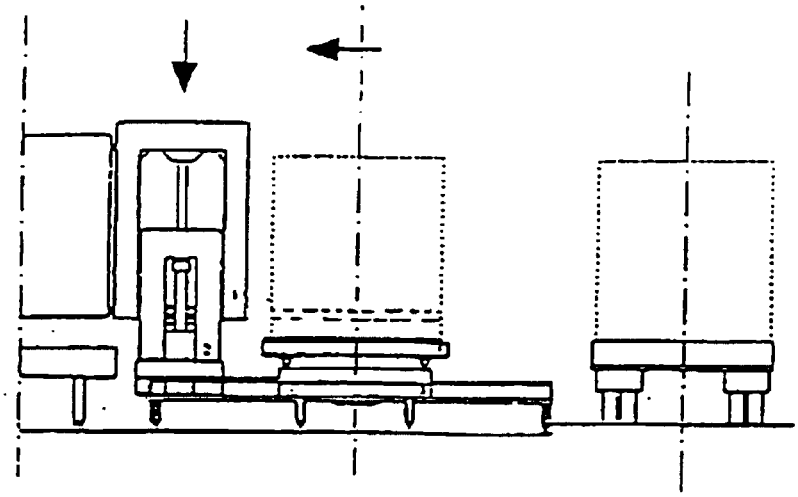
Figure 11B:
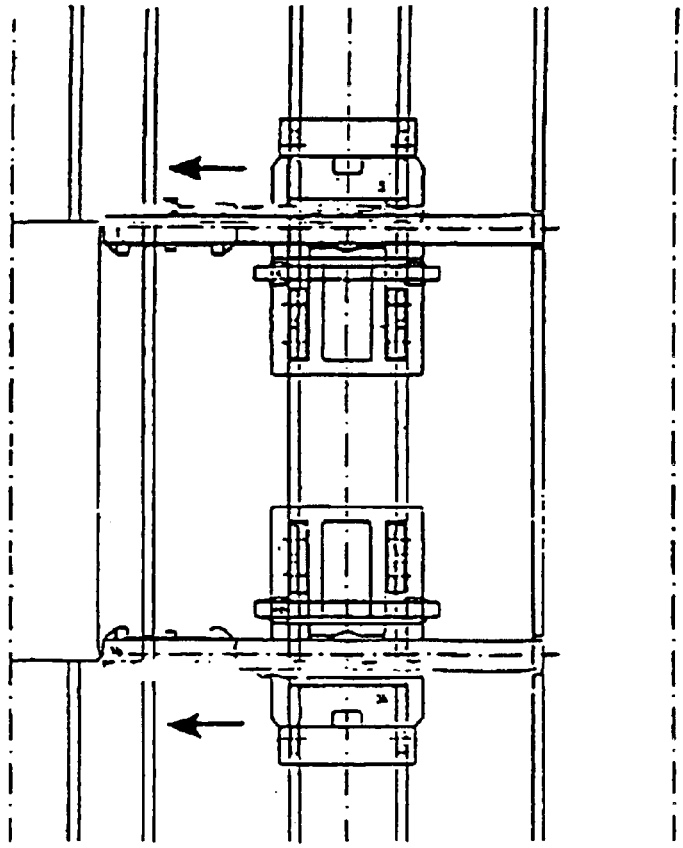

The container is then lifted and moved to a central position on the base cars, as shown in FIG. 8. After the container has been lowered to the container supports, the carriages are retracted and the base cars move off from each other until they have room enough to take a central position (FIG. 9). In this position, the beam supports are released and the cars travel with the container to the (opposite) loading position, wherein the carriages roll to the other side and the base cars approach to each other (FIG. 10). Being in the correct position and the beam supports being active, the grips are pushed forward and turned on to clamp the container, which is then lifted and moved to the other side (FIG. 1).

Figure 12A:
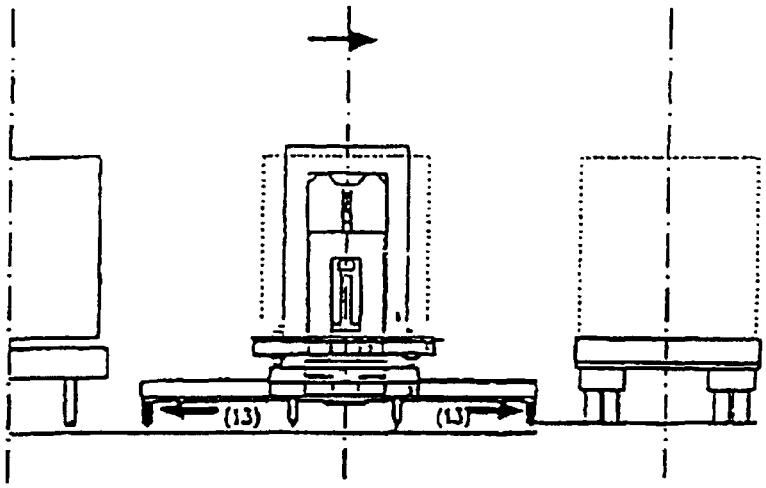
Figure 12B:
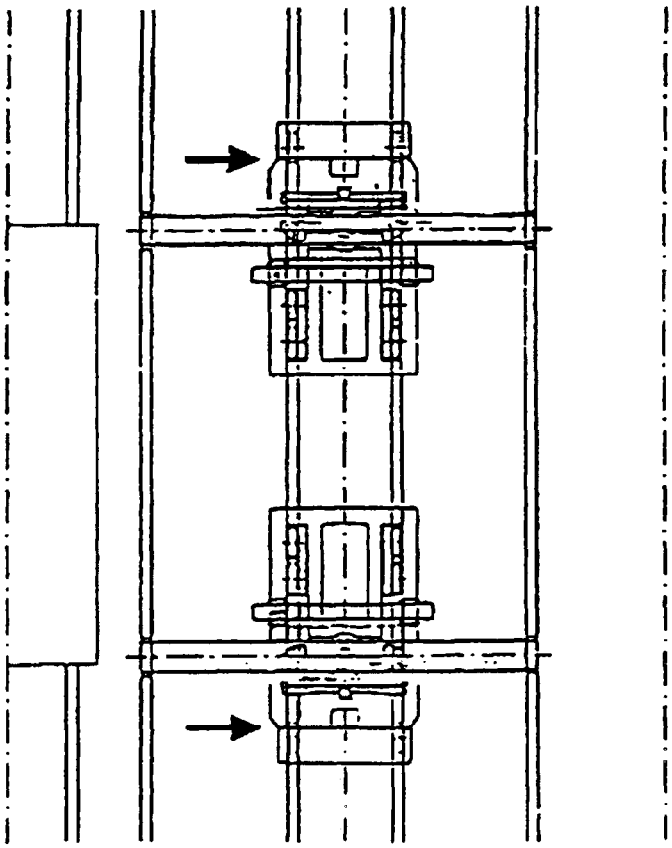

The container is then loaded to the railway car and the base cars of the apparatus return into start position (FIG. 12).

Figure 13A:
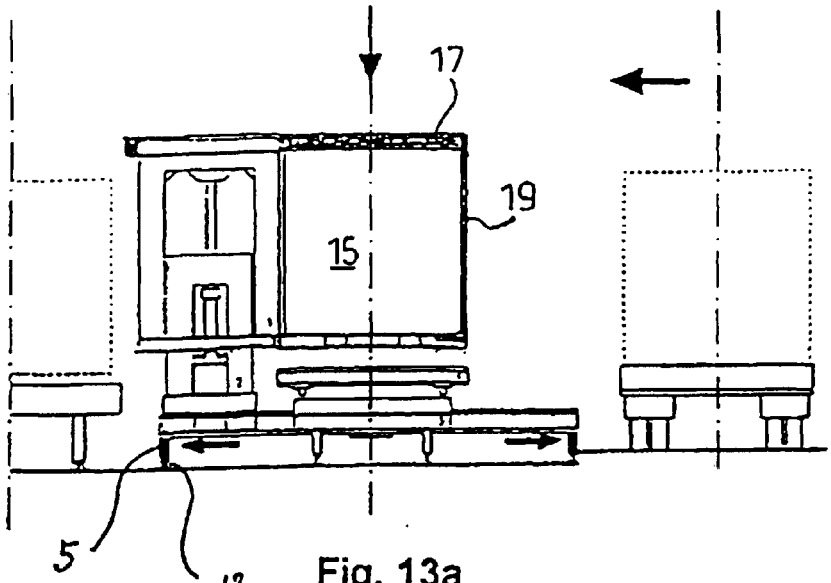
FIG. 13 shows the loading of a soft top container with the upper lift beams.
Figure 13B:
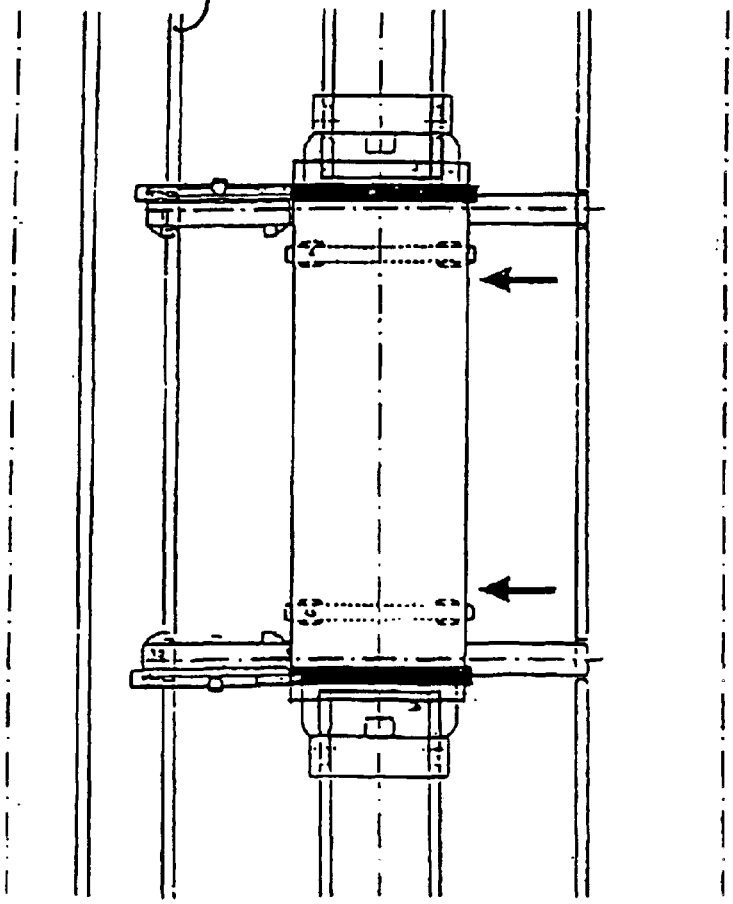

In most cases, the standard containers provided with ISO connections can be moved by clamping with the upper grips only. At the lower section of the container, it is generally sufficient to apply abutments. Lately, however, soft top (swap) containers have appeared, as referred to above, which cannot be clamped on the upper part. In such cases, the lower grips are used for clamping the container and the folded arms on the upper lifting beams support the container to prevent tilting as shown in FIG. 13. The container clamped in this way may be moved as already shown in FIGS. 6 to 12.

FIGS. 14 to 20 show the use of the lower lifting beams.

Figure 14A:
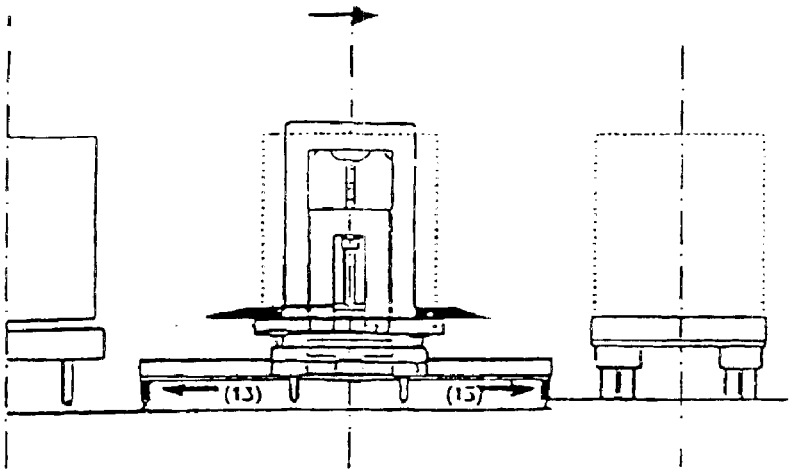
FIGS. 14 to 20 show the steps of reloading a container with the lower lift beams.
Figure 14B:
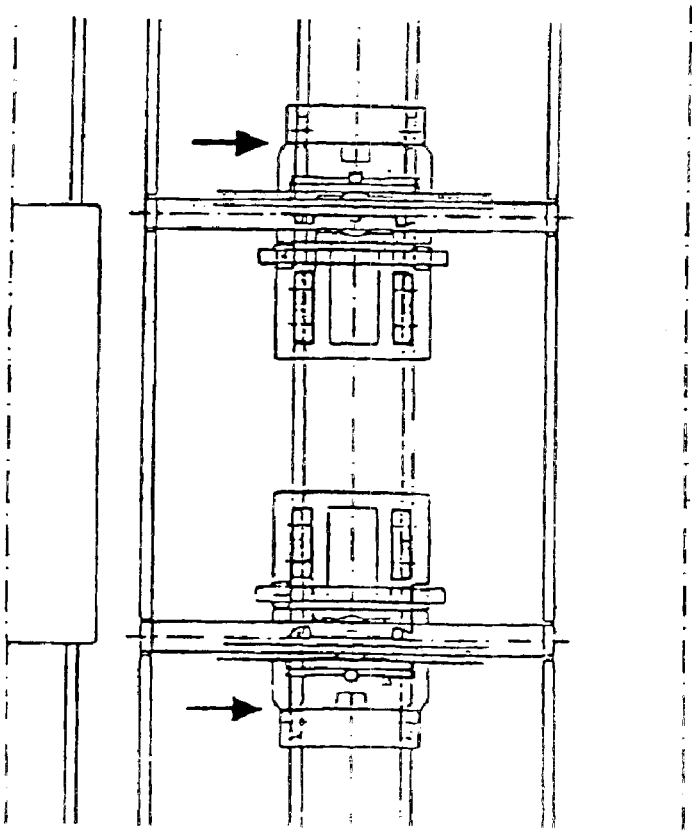
Figure 15A:
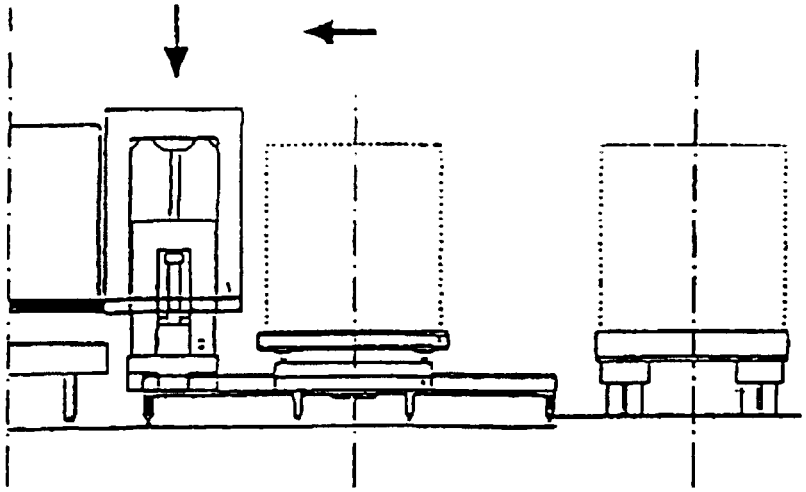
Figure 15B:
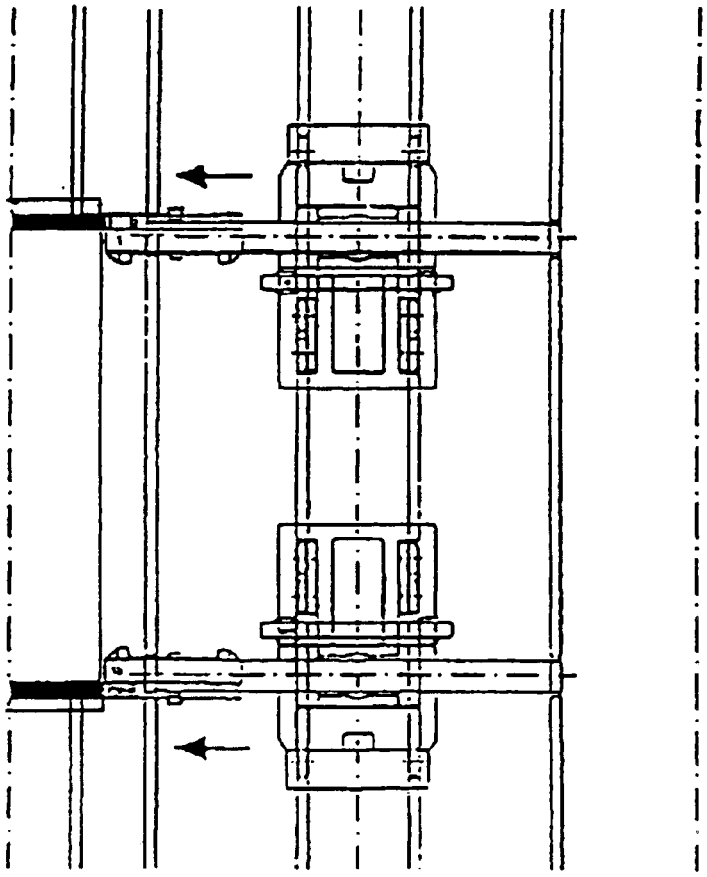

In FIG. 14 both the base cars are in starting position, the lifting elements are lowered and the beams are in central position.

First, the base cars take a position corresponding to the length of the container to be moved, then the carriages move to the right position. Horizontally adjusted, the carriages approach the container and the upper extension brackets push the upper part of the container to tilt it. In this tilted position, the lower beams are pushed below the container and the extension brackets are retracted to allow the container to rest fully on the lower beams.

Figure 16A:
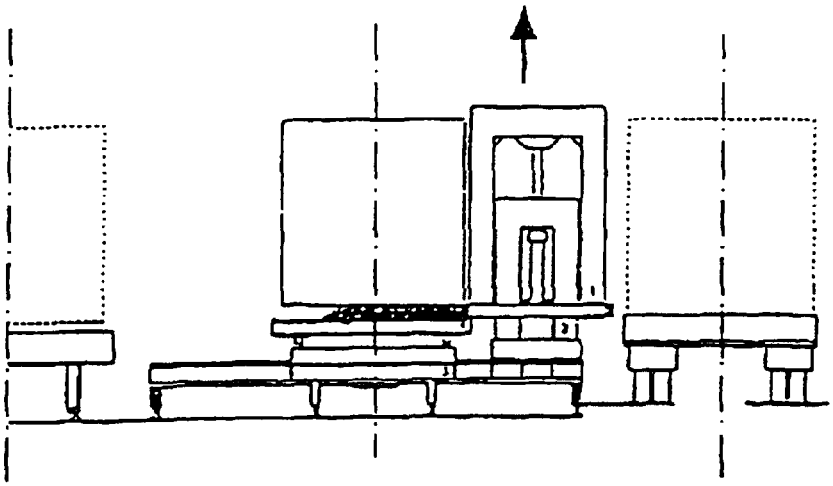
Figure 16B:
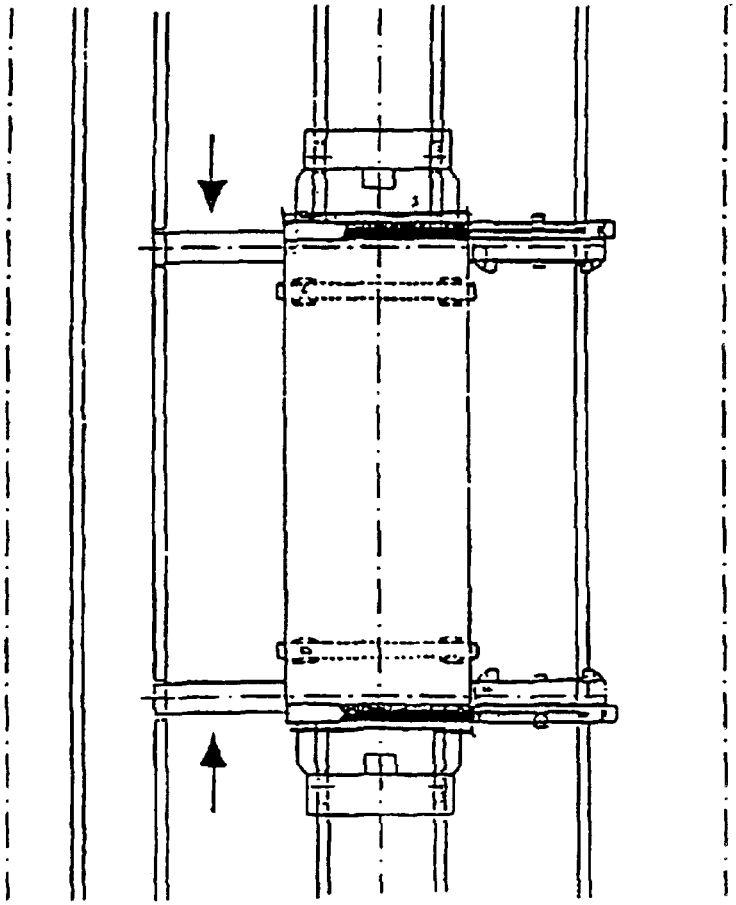
Figure 17A:
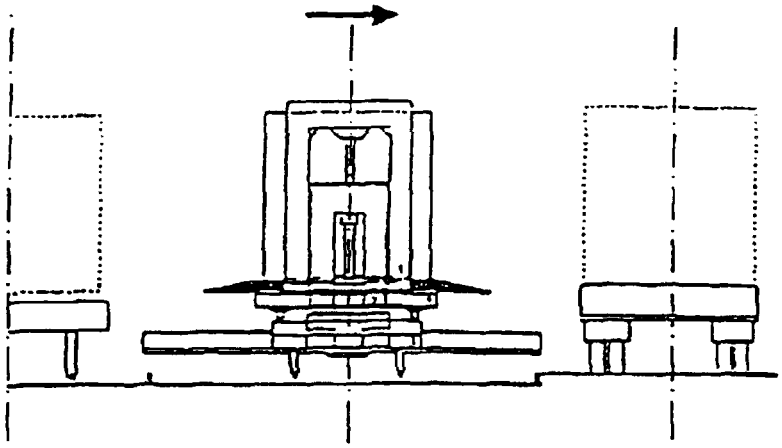
Figure 17B:
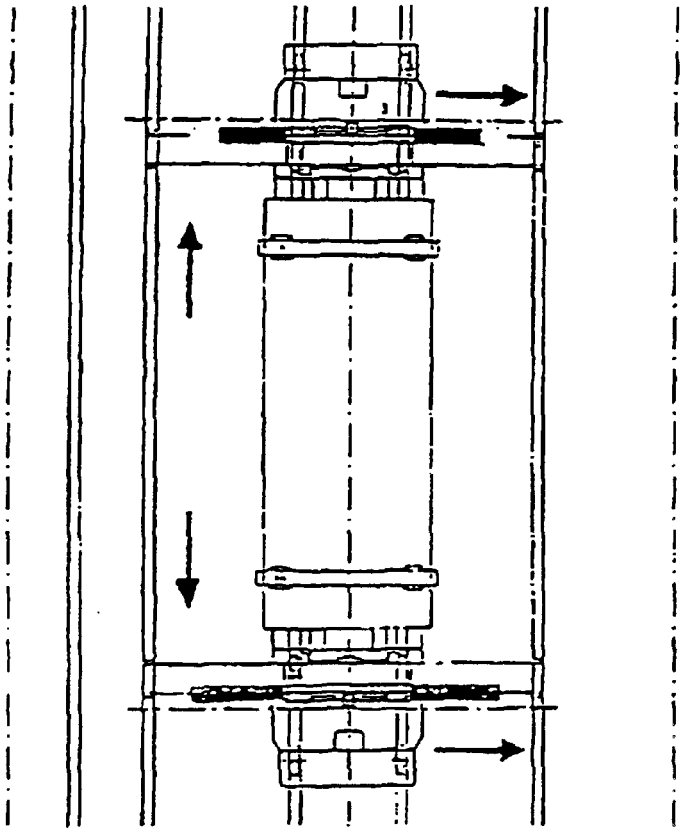
Figure 18A:
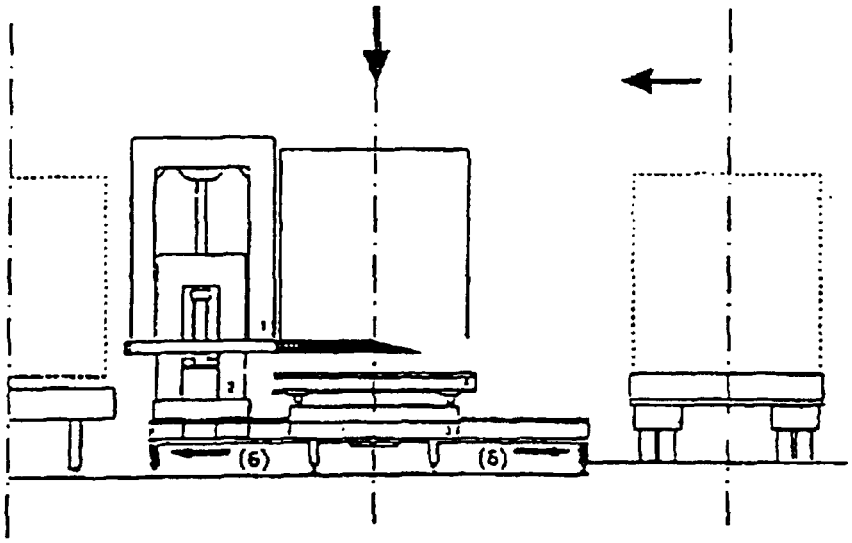
Figure 18B:
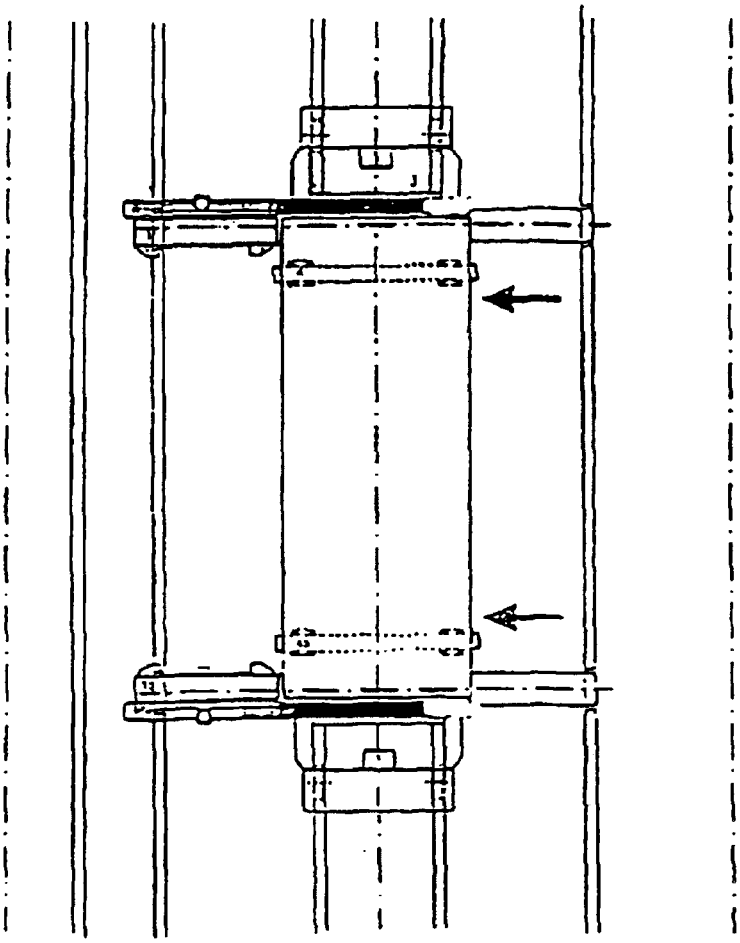
Figure 19A:
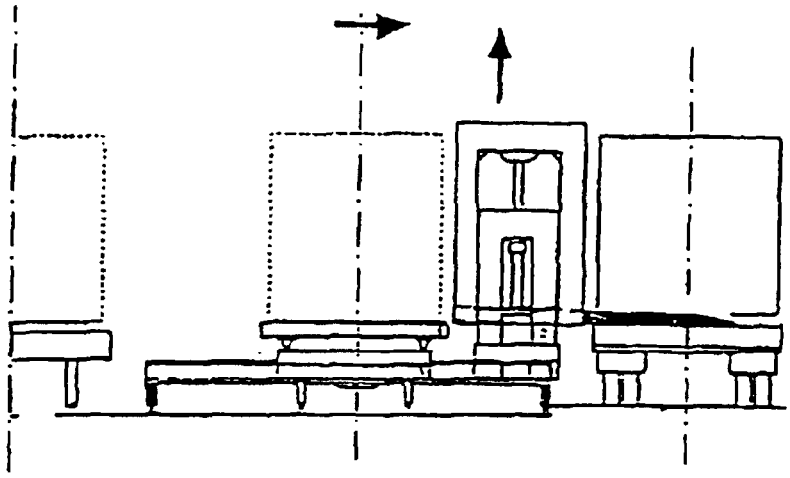
Figure 19B:
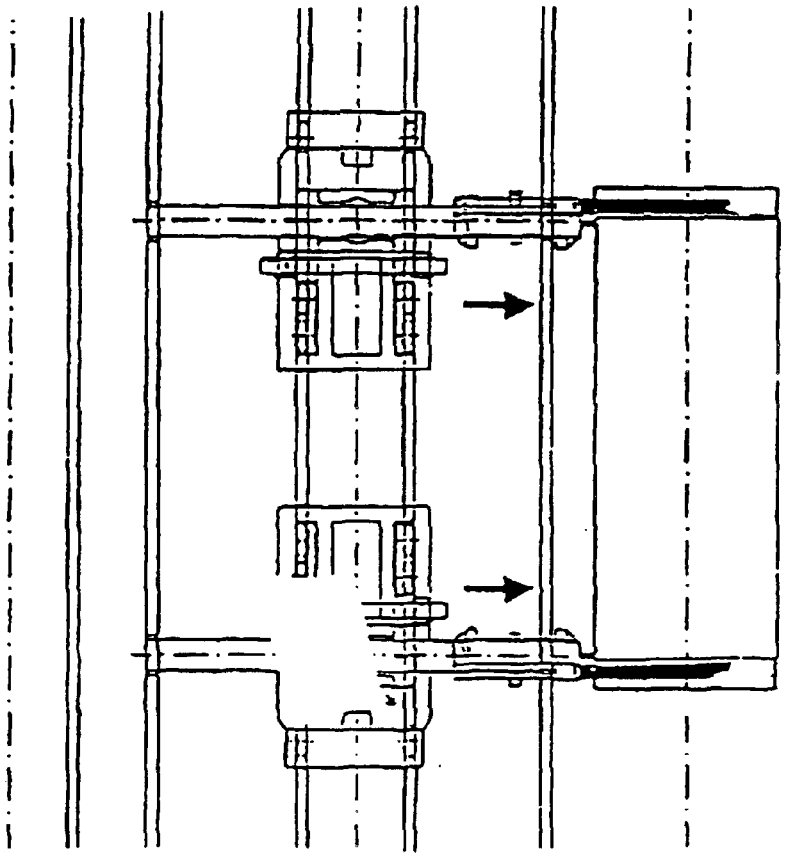
Figure 20A:
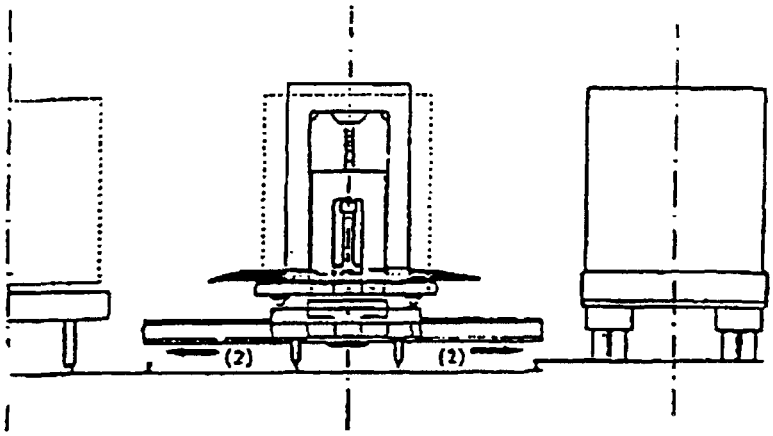
Figure 20B:
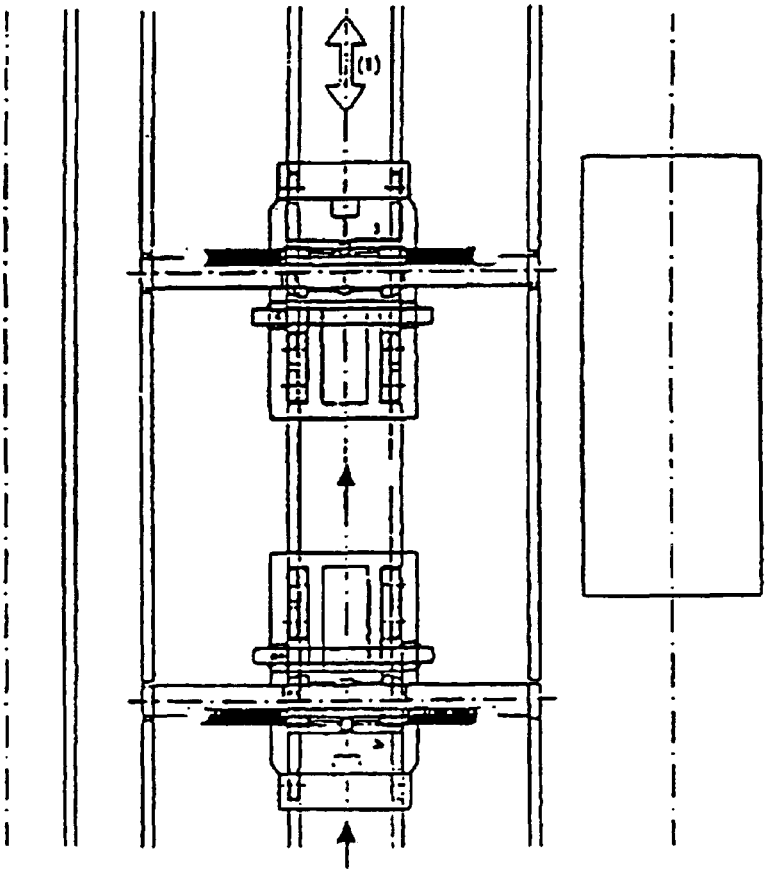

The container is then lifted (FIG. 15) and moved to a central position on the base cars, as shown in FIG. 16. After the container has been lowered to the container supports, the carriages are retracted and the base cars move off from each other until they have room enough to take a central position (FIG. 17). In this position, the cars travel with the container to the (opposite) loading position, wherein the carriages roll to the other side and the base cars approach each other. Being in the correct position, the beams are pushed forward and the container is then lifted (FIG. 18), moved to the other side and lowered there (FIG. 19). The base cars of the apparatus return to start position (FIG. 20).

Figure 21:
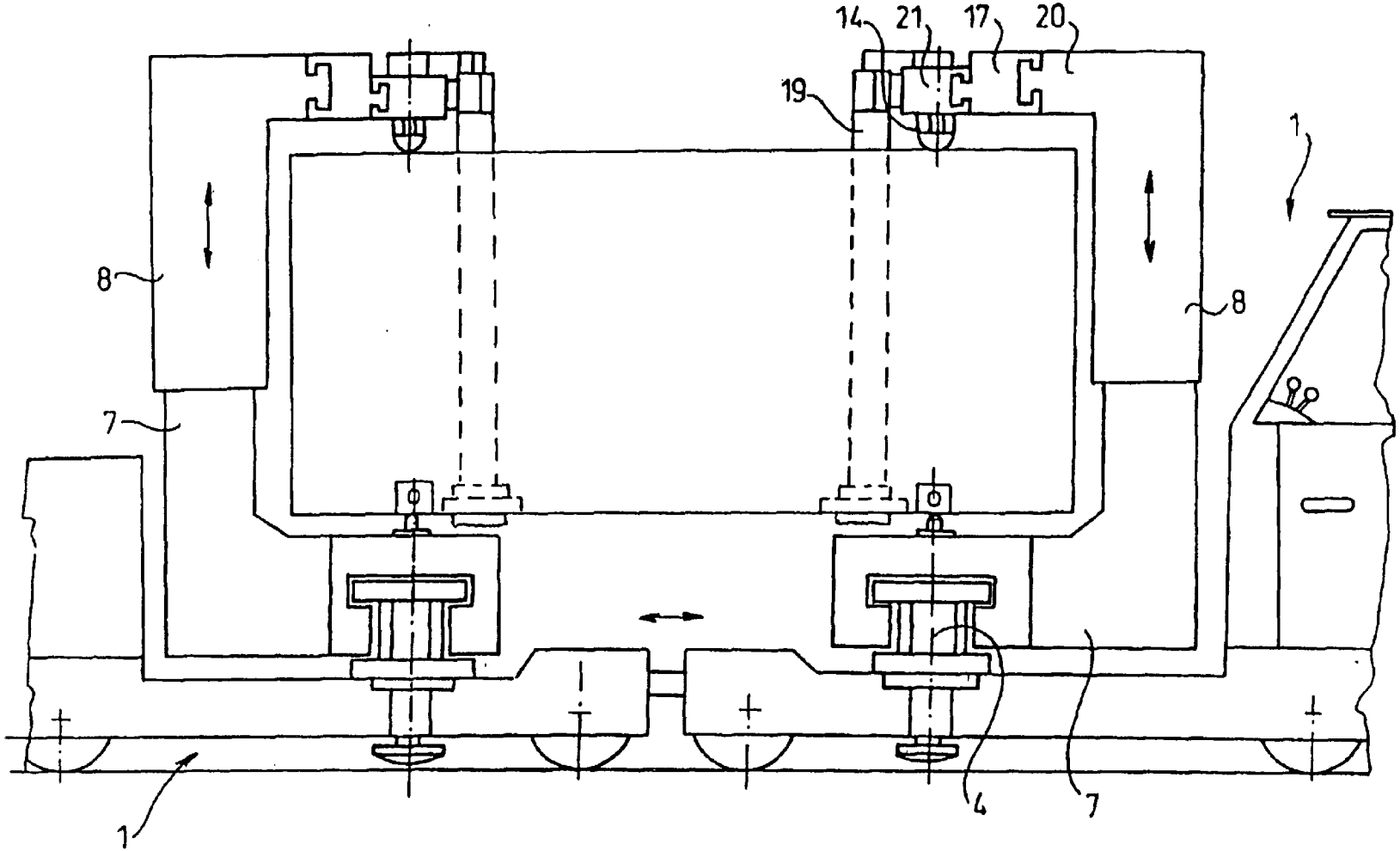
FIG. 21 is the side view of another embodiment of the apparatus when lifting a container.
Figure 22:
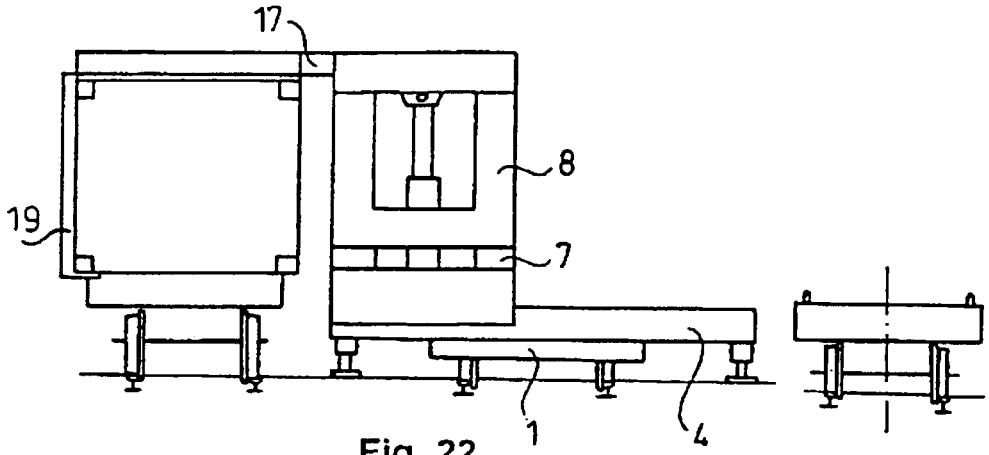
FIGS. 22 to 24 show the further steps of reloading the container in FIG. 21, and FIGS. 25 and 26 show the front and side view of another embodiment of the apparatus.

Another preferred embodiment may be seen in FIG. 21.

Here, the lifting frames 8 have, on the upper ends, horizontal consoles 20 and the upper lifting beams 17 are guided at the end of these consoles. The ISO grips 14 and lifting arms 19 are fixed to slides 21 mounted for transverse movement on the beams 17.

Figure 23:
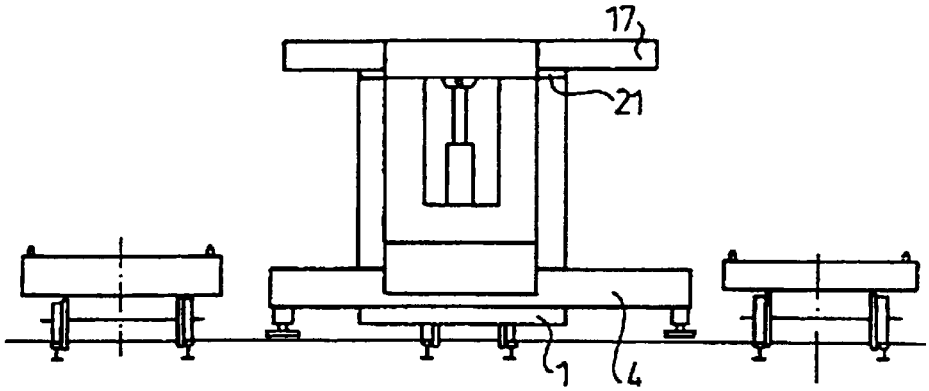

The base cars 1 do not comprise container support beams, the containers are supported—if necessary—by the lower part of the lifting means 7 themselves. FIG. 21 shows the step when the container is just lifted by the foldable lifting arms 19. The same step can be seen in FIG. 22, wherein the apparatus is shown in front view. The next steps are shown in FIG. 23 and FIG. 24.

Figure 24:
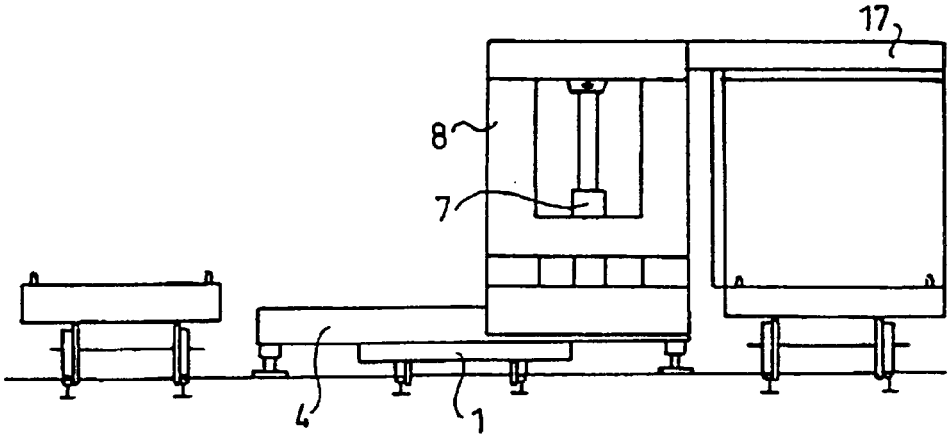

Lifting means 7 travels to central position (FIG. 23) and the container is laid on to the lower part of the lifting means 7 by arms 19 and the grips on that part clamp the container (FIG. 24). Then the base cars 1 travel with the container to the required place and the container is lifted and moved to the other side to be loaded on the other railway car. It is to be noted that the container is not necessarily lowered and clamped in the middle position in the case when only transverse movement of the container is necessary.

Figure 25:
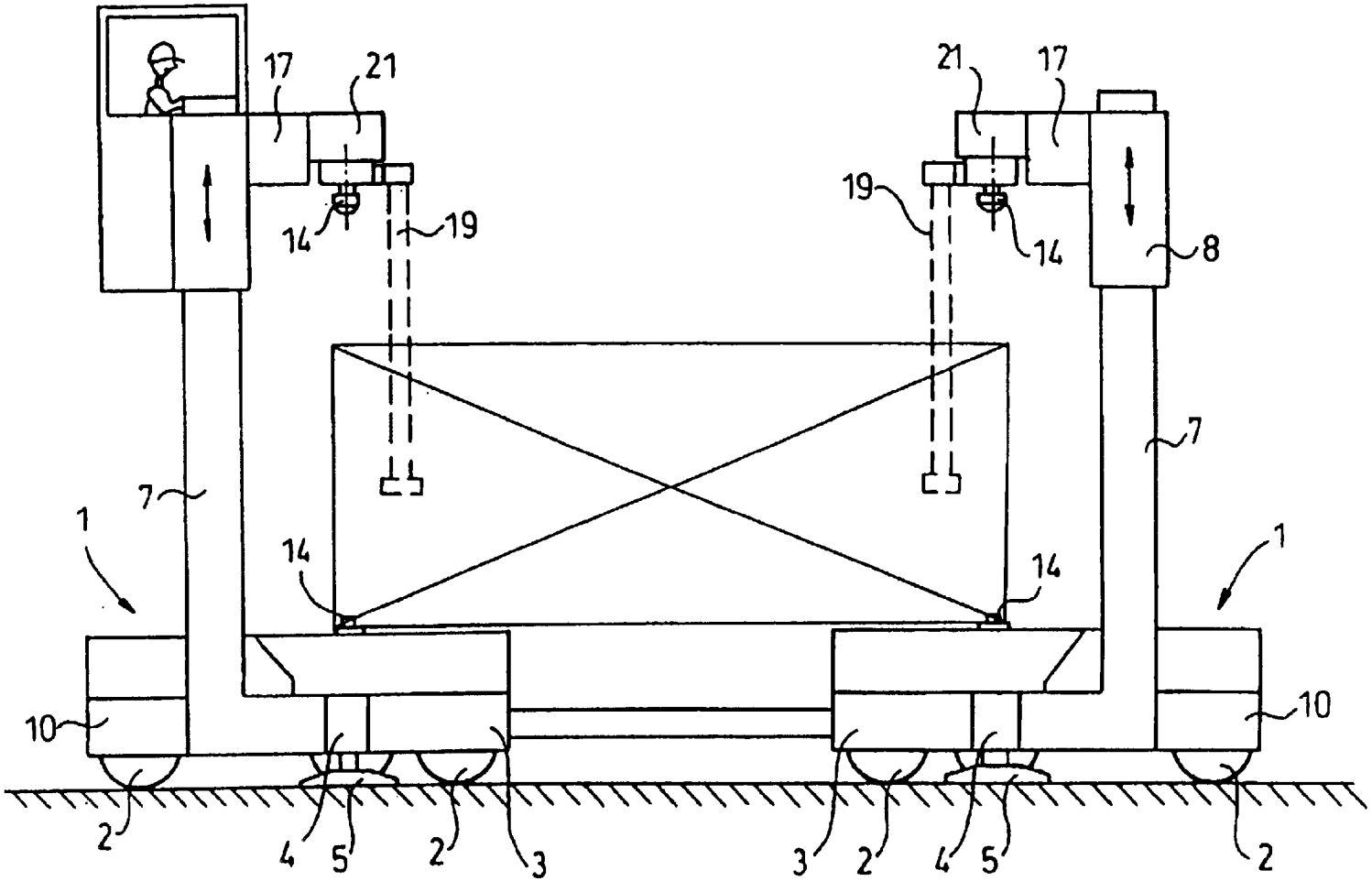
Figure 26:
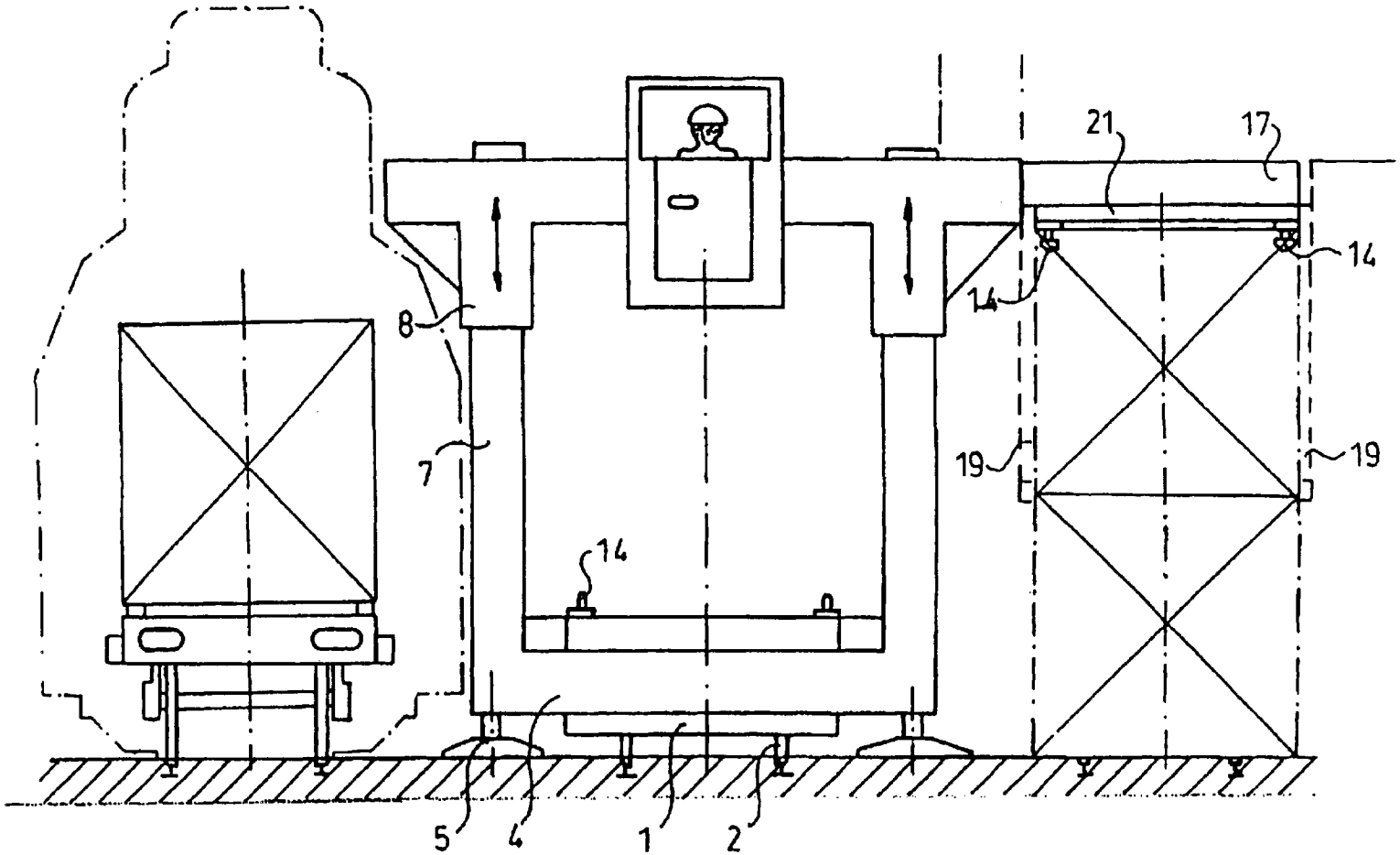

A further embodiment of the invention is shown in FIG. 25 (side view) and FIG. 26 (front view). This embodiment is a preferred form if the whole area of passage can be used and the containers should be loaded onto the ground or onto the top of each other.

In the apparatus illustrated in these figures, lifting frames 8 are similar to those shown in the previous figures but lifting means 7 are mounted directly on the beams 4 instead of moving on carriages. Accordingly, transverse movement is carried out exclusively by the upper lifting beams 17 and slides 21 that move along and carry lifting arms 19 as well as grips 14.

The embodiments shown by the way of example illustrate that the apparatus according to the invention can be used for loading, unloading and transferring any kind of containers or other standard loads easily and effectively, without the danger of touching overhead wires. Loading is faster and easier than in the conventional way, and operating the system is also easier than before. The apparatus can be installed without considerable additional costs and, last but not least, use of the apparatus according to the present invention does not contribute to air pollution.

While several preferred embodiments of the apparatus according to the invention have been described in some detail, it will be obvious to one skilled in the art that various modifications may be made without departing from the invention as hereinafter claimed.

What is claimed is:

1. An apparatus operative to perform at least one of lifting and moving of a container, comprising:

a first base car and a second base car, both base cars being adapted to engage front and rear sections, respectively, of the container, and being arranged antimerically to and synchronously movable with each other, each base car in comprising a base structure having pairs of wheels connected by respective axles, a counterweight, a transverse beam arranged on the base structure parallel with the axles of the wheels, and container supports provided above the transverse beam, wherein the transverse beam comprises a container moving unit which comprises upper and lower container grips and at least one of upper and lower lifting beams.

2. The apparatus according to claim 1, wherein the container supports comprise beams.

3. The apparatus according to claim 1, further comprising rollers operative to permit the container supports to move on the base cars in a longitudinal direction.

4. The apparatus according to claim 1, wherein the container supports comprise roller plates.

5. The apparatus according to claim 1, further comprising rollers operative to permit the container moving units to move on the beams of the base structures.

6. The apparatus according to claim 1, wherein the transverse beams of the base structures are arranged lower than a level of a plateau of the base structures.

7. The apparatus according to claim 1, further comprising a mechanical connection between the base cars.

8. The apparatus according to claim 1, further comprising an electronic, radio or mechanical connection between the base cars.

9. The apparatus according to claim 1, wherein the base cars include supports comprising support wheels.

10. The apparatus according to claim 1, wherein the base cars include supports comprising supporting legs.

11. The apparatus according to claim 1, wherein the container moving units comprise at least one of lifting frames and lifting columns moved by lifting means.

12. The apparatus according to claim 11, wherein the at least one of lifting frames and lifting columns comprise at least one horizontal upper console and at least a portion of the container grips are on the consoles.

13. The apparatus according to claim 11, wherein the at least one of lower and upper lifting beams is arranged on at least one of the lifting frames and lifting columns.

14. The apparatus according to claim 1, further comprising carriages arranged on each base car and lifting means arranged on the carriages.

15. The apparatus according to claim 1, wherein the apparatus includes upper lifting beams and further comprising slides arranged on the upper lifting beams and movable along the lifting beams.

16. An apparatus operative to perform at least one of lifting and moving containers, the apparatus comprising:

a base structure having two opposite sides and being provided with wheels, a counterweight and supports on the two opposite sides, wherein transverse beams are arranged on the base structure parallel with axles of the wheels, the beams including container moving units, wherein the base structure comprises two base cars arranged antimerically to and movable synchronously with each other, both base cars comprising container moving units having upper and lower container grips for fitting in standard ISO elements on containers, wherein the container moving units comprise at least one of traveling lower and upper lifting beams, and wherein each car further comprises container supports provided above the transverse beams.

* * * * *